United States Patent [19]

Nelson

[11] 4,095,319

[45] Jun. 20, 1978

[54] YARN FRACTURING AND ENTANGLING JET

[75] Inventor: Jackson Lee Nelson, Johnson City, Tenn.

[73] Assignee: Eastman Kodak Company, Rochester, N.Y.

[21] Appl. No.: 762,614

[22] Filed: Jan. 26, 1977

[51] Int. Cl.[2] ..... D02G 1/16

[52] U.S. Cl. ..... 28/273

[58] Field of Search ..... 28/273

[56] References Cited

U.S. PATENT DOCUMENTS

| | | | |
|---|---|---|---|
| 2,924,868 | 2/1960 | Dyer | 28/273 |
| 2,956,328 | 10/1960 | Faw | 28/273 X |
| 3,110,950 | 11/1963 | Yamamoto | 28/273 |
| 3,462,813 | 8/1969 | Dyer | 28/273 |
| 4,025,994 | 5/1977 | Phillips | 28/273 |
| 4,026,099 | 5/1977 | Phillips | 28/273 X |

*Primary Examiner*—Robert R. Mackey

*Attorney, Agent, or Firm*—Malcolm G. Dunn; Daniel B. Reece, III

[57] ABSTRACT

Jet using high pressured gaseous fluid to partially fracture yarn and to entangle the yarn, the jet being a significant improvement over the jet disclosed in the Dyer patent, U.S. 2,924,868, which has a housing provided with a gas inlet, a yarn guiding needle, orifice plate, and venturi; the improvement including reducing the size of the passageways through the needle, orifice plate and venturi, and selectively providing the inward taper of the outer wall of the yarn guiding needle inner end portion with a half angle of about 15° relative to the axis of the needle yarn guiding passageway, providing the wall of the orifice plate entry opening with an inwardly tapering bevel of about 30° relative to the axis of the entry opening, and providing the diverging wall portion of the venturi exit opening with a half angle of about 2.5° relative to the venturi axis.

4 Claims, 3 Drawing Figures

Fig 2-A

YARN FRACTURING AND ENTANGLING JET

BACKGROUND OF THE INVENTION

The present invention is directed to a jet using pressurized gaseous fluids for fracturing or partially fracturing yarns of certain fiber cross-sections and for entangling the yarns, and particularly to a jet that constitutes an improvement over the jet disclosed in the Dyer patent, U.S. Pat. No. 2,924,868.

The use of jets or jet devices employing gaseous fluids, usually air, for treating yarns and textile yarns in some manner is known. Jets may be used to entangle multifilaments of yarn, to bulk or loft yarn, to splice yarn ends by entangling, to feed and convey yarn, etc.

The White patent, U.S. Pat. No. 3,242,035, for instance, discloses a jet for fibrillating a film strip of polymeric material by contacting successive portions of the film strip with a high velocity jet or stream of gas or air to produce a cohesive rupture of the filmstrip. The resulting product is a bulky multifibrous yarn made up of fibrils of irregular length, the fibrils being interconnected at random points to form a cohesive unitary or one piece network structure. The jet structure involves simply a cylindrical yarn passageway, which is intersected by a gas passageway.

There are other types of jets, however, which employ the use of needles or small nozzles and venturis, with the yarn passing through the needle or nozzle and through the venturi. The instant invention employs structure of this type and not structure of the type disclosed by the White patent mentioned above. The jet structures, which employ the venturi, may be used to bulk or loft yarn, such as the previously mentioned Dyer patent, U.S. Pat. No. 2,924,868. The Breen patent, U.S. Pat. No. 2,869,967, discloses in FIG. 4, for instance, another example of such venturi construction, which is used to form a bulky yarn. In one embodiment of the Breen patent, yarn composed of substantially continuous filaments is fed through a jet operated under conditions such that the filaments are shattered at random intervals to provide desired free ends of projecting fiber. The jet creates a turbulence that causes separation of the filaments and then causes the separated filaments to be whipped about with such rapidity that the flex life of the material is quickly exceeded and some or many of the filaments are caused to be broken. The severity of the shattering effect varies with the flex life of the filament material.

Other jet constructions may be mentioned, but the structure of the present invention more closely resembles the structure disclosed in the aforementioned Dyer patent, U.S. Pat. No. 2,924,868, than the other structures. Therefore, a discussion in the rest of this specification of the differences between these two structures will be more significant for a better understanding of the invention.

An object of the present invention, therefore, is to provide a jet capable of using high pressures on the order of 300 to 500 psig. of a gaseous fluid, such as air, to partially fracture a yarn, such as a polyester yarn, wherein the yarn comprises individual filament cross-sections, each having a central, nearly cylindrical body with two lateral "wings" diametrically extending from the central cylindrical body along the same diametrical line, and the high pressures of the jet serve to partially sever the "wings" to form protecting ends along the length of the central body.

Another object of the invention is to provide a jet that is not only capable of using the high pressures of gaseous fluid previously mentioned but is also capable of partially severing the "wings" of the individual filaments in the manner mentioned and entangling the filaments to form them into a cohesive yarn body.

Still another object of the invention is not only to provide a jet of the capabilities mentioned above, but also to provide a jet that can use such high pressures but at a significantly reduced rate of gas or air consumption previously known, at least as compared with the use of the Dyer jet construction if not also as compared to the other structures, that makes the use of the jet highly commercially attractive in producing partially fractured yarn and entangled yarn in the manner briefly described above.

SUMMARY OF THE INVENTION

The present invention, therefore, is directed to a jet for using high pressured gaseous fluid to partially fracture and to entangle yarn, particularly polyester yarn having the filamentary cross-sections of the type described above. Although the jet would also be capable of working with other types of yarns and filament cross-sections, I am more familiar at present with the particular polyester filament cross-section mentioned and the desirable results produced in yarn of this type by the jet of my invention. The yarn itself is the subject of a separate invention by others.

The environment of the jet of my invention includes an elongated housing having a central bore therethrough that forms in part a plenum chamber. A venturi is supported in the central bore at the exit end of the housing and defines a passageway therethrough for yarn and gas. The inner end of the venturi has a central entry opening followed by a converging wall surface terminating in a constant diametered throat with a length approaching that of its diameter, the throat in turn being followed by a diverging wall portion leading to a central exit opening extending through the exit end of the venturi. An orifice plate is supported in the central bore of the housing in abutment against the inner end of the venturi and has a central entry opening therethrough concentric with the central opening of the venturi. The wall of the orifice plate entry opening has an inwardly tapering bevel terminating in an exit opening of constant diameter. A yarn guiding needle is positioned in the central bore of the housing and has an inner end portion that is adjustably and closely spaced adjacent the entry opening of the orifice plate. The needle has extending therethrough an axial yarn guiding passageway terminating in an exit opening for directing yarn through the needle and toward the entry opening of the orifice plate. The outer wall of the needle inner end portion adjacent its exit opening is inwardly tapered toward the orifice plate entry opening. A gas inlet leads into the central bore of the housing to provide a high pressured gaseous fluid, such as air, to the plenum chamber whereby the gaseous fluid passes through the orifice plate entry opening and venturi entry opening and outwardly through the venturi exit opening to partially fracture yarn and to entangle the filaments of the yarn as the yarn passes through the venturi from the needle axial yarn guiding passageway and the opening in the orifice plate.

My improvement to the above-described jet environment includes selectively providing the inward taper of the outer wall of the needle inner end portion with a half angle of about 15° relative to the axis of the yarn guiding passageway, providing the wall of the orifice plate central entry opening with an inwardly tapering bevel of about 30° relative to the axis of the central entry opening, and providing the diverging wall portion of the exit opening of the venturi with a half angle of about 2.5° relative to the axis of the opening. The throat of the venturi extends inwardly from the central entry by a distance of about 0.094 inch, has a length of about 0.031 inch and a diameter of about 0.033 inch. The venturi converging wall portion has an angle of about 17.5° relative to the venturi central entry opening and the venturi central entry opening has a diameter of about 0.062 inch. The exit opening of the orifice plate has a diameter of about 0.031 inch, the length of the orifice plate exit opening is about 0.010 inch and the orifice plate thickness is about 0.063 inch. It is thought that the needle exit opening should have a diameter equal to or less than the diameter of the venturi throat. The angles and dimensions are thought to be critical to the effectiveness of my invention.

It is thought that the particular geometry of the jet construction of my invention along with the use of gaseous pressures sufficient to produce sonic flow at the throat of the venturi may cause a shock wave to occur near the exit opening of the venturi. Some or all of the yarn fracture may occur at the shock wave, and perhaps some entanglement may also occur there as well as in the supersonic portion of the jet, which extends from the venturi throat to the point at which the shock wave occurs.

DESCRIPTION OF THE DRAWINGS

In the drawings:

FIG. 2A is a cross-sectional view in elevation of an exploded detail of the venturi and the orifice plate shown in FIG. 2.

DESCRIPTION OF THE PREFERRED EMBODIMENT

(a) Prior Art — Dyer Jet

Figure 1:
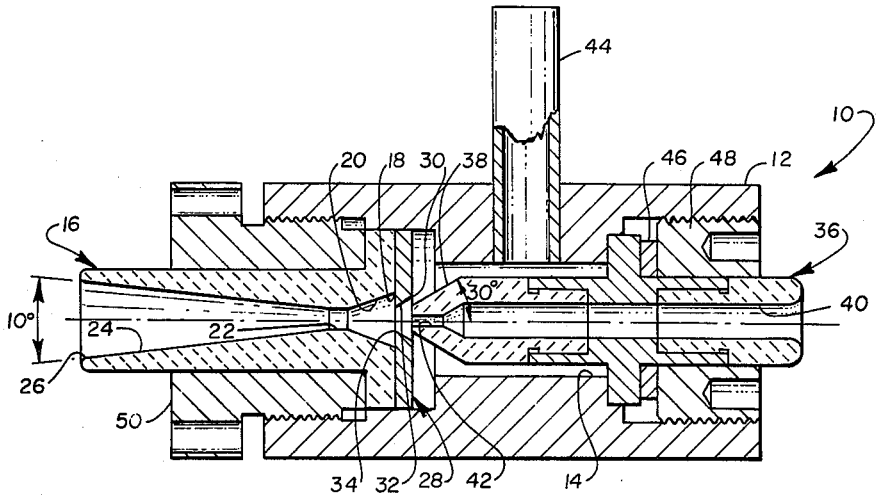
PRIOR ART Fig 1
FIG. 1 is a cross-sectional view in elevation of the Dyer jet, such as is disclosed in the Dyer patent, U.S. Pat. No. 2,924,868.

In reference to FIG. 1, the Dyer jet 10 similar to that disclosed in the Dyer patent, U.S. Pat. No. 2,924,868, is illustrated for the purposes of being compared with the jet of my invention and the unexpected results I obtained when I changed certain of the dimensions.

The Dyer patent discloses a number of dimensions for the various diameters, angles, openings, etc. of a jet, such dimensions being suitable for use in constructing a jet for bulking or lofting yarn. It will be noted, for instance, in column 6 of the specification, that air pressures of 8 psig. and 20 psig. were indicated, while in different parts of the specification air pressures ranging from 5–50 psig. and 10–70 psig. are mentioned, with air consumptions ranging around 2 to 10 cubic feet per minute, or at a relatively low order. These lower pressures and lower air consumption rates are thought to be typical for use in lofting yarns.

The Dyer jet 10 has an elongated housing 12 provided with a central bore 14, which also defines in part a plenum chamber for receiving therein a gaseous fluid.

A venturi 16 is supported in the central bore in the exit end of the housing and has a passageway extending through the venturi with a central entry opening 18, a converging wall portion 20, a constant diametered throat 22 with a length nearly the same as the diameter, a diverging wall portion 24 and a central exit opening 26.

An orifice plate 28 is supported in the central bore and abuts against the inner end of the venturi in the manner shown. The orifice plate has a central entry opening 30, which is concentric with the central entry opening of the venturi, and the wall 32 of the entry opening has an inwardly tapering bevel terminating in an exit opening 34.

A yarn guiding needle 36 is also positioned in the central bore of the housing and has an inner end portion 38 spaced closely adjacent the central entry opening of the orifice plate. The needle has an axial yarn guiding passageway 40, which extends through the needle and terminates in an exit opening 42. The outer wall of the inner end portion of the needle adjacent the exit opening 42 is inwardly tapered toward the orifice plate in the manner shown.

An inlet or conduit 44 serves to introduce the gaseous treating fluid, such as air, into the plenum chamber of the central bore 14 of the housing 12.

The needle may be held in position within the central bore by means of gasket 46 and threaded plug 48.

The venturi 16 may also be held in position within the central bore by a threaded plug 50.

To give some idea of the differences with and/or similarities of the Dyer jet to the jet of the present invention, the outer wall of the inner end portion of the needle has an inwardly tapered half angle angle of about 30° relative to the axis of the needle, and the needle exit opening is about 0.043 inch. The orifice plate has a thickness of about 0.063 inch, an entry opening of about 0.218 inch, and an exit opening of about 0.094 inch. The venturi has a length of about 1 13/16 inches, the diameter of the throat is about 0.100 inch and the length of the throat is about 0.0625 inch. The exit opening of the venturi diverges at an angle of about 10° or has a half angle of about 5°, as measured relative to the axis of the venturi.

The Dyer jet was used to partially fracture the yarn described above, using increased gaseous fluid pressures of about 200 to 300 psig. In order to make the jet operate for fracturing and entangling yarn, the jet was adjusted to give a blow back of 5 psig. as determined by the following procedure. A constant 20 psig. air source was attached to the air inlet of the jet by a rubber hose. The yarn inlet of the jet was pressed and sealed against a pressure gauge. The bottom plug (item 36 in FIG. 1 of the Dyer patent) is adjusted until 5 psig. is obtained on the pressure gauge. This jet is said to be adjusted to a blow back of 5 psig. The gaseous fluid consumption at 200 psig., for instance, was about 30 SCFM, which was not considered to be commercially practical for producing the yarn mentioned above, as the costs of the gaseous fluid, air, for instance, were too high.

The jet of my invention, however, is able to use still higher pressures such as 300 to 500 psig., but with a significantly lower air consumption rate of only about 6.5 SCFM when using as much as 500 psig., and the partially fractured yarn product has a different appearance at a significantly more commercially attractive production cost.

(b) Jet of The Invention

Figure 2:
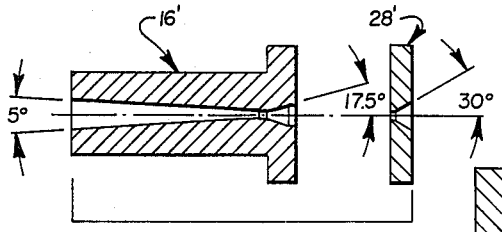
FIG. 2 is a cross-sectional view in elevation of the jet of the present invention.
Figure 2:
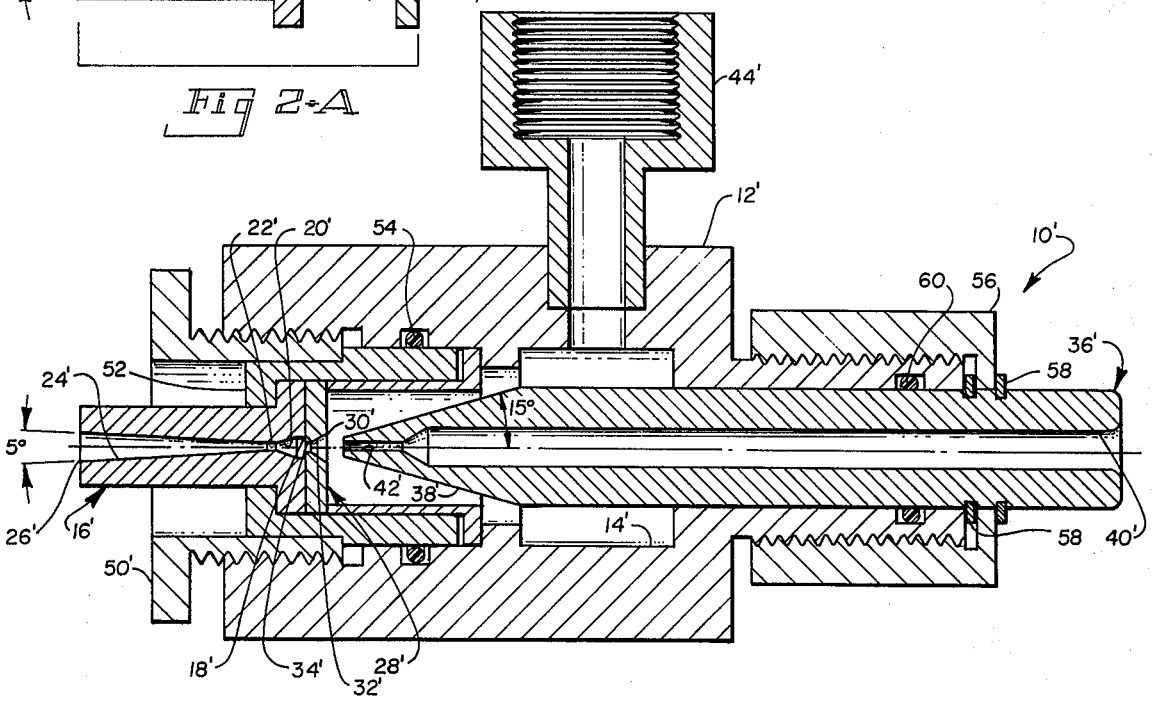

The reference numbers used to identify the different elements of the Dyer jet are used in FIG. 2 and FIG. 2A of the drawings to identify similar corresponding elements in the jet of the invention but with an added prime mark after each such reference number to distinguish the two jet constructions. The description of the different elements of the jet of my invention will not in every instance be repeated with respect to those elements that essentially correspond in identity with the Dyer jet elements.

The elongated housing 12' of the jet 10' of my invention has been increased in size with respect to the Dyer jet 10 so as to enable the jet to withstand the still higher gaseous fluid pressures, such as on the order of 300 to 500 psig. Although the drawings may not be to scale, an attempt has been made to show the relative proportional differences in sizes between the two jet constructions. Thus, it will be noted, for instance, that the venturi 16' and its passageway are considerably smaller than the Dyer venturi 16 and its corresponding passageway, and that the angle of the venturi exit opening 26' has been changed. Similarly also, opening 30' is smaller than the Dyer orifice plate central entry opening 30. The needle exit opening 42' is smaller than the Dyer needle opening 42, and the needle inner end portion 38' has been given a different tapering bevel.

Some of the changes have been highlighted above to call attention to some of the features of my jet invention that are thought to be important. The results were surprising and unexpected to me and I am not presently aware of which of the changed features are the more significant ones responsible for accomplishing the results obtained by use of my jet.

The inward taper of the outer wall of the needle inner end portion 38' was selectively reduced to about 15° relative to the axis of the axial yarn guiding passageway 40' from the 30° employed in the Dyer needle 36. The needle exit opening has a diameter of about 0.025 inch.

The wall of the central entry opening 30' of the orifice plate 28' has an inwardly tapering bevel of about 30° relative to the axis of the entry opening 32', the exit opening 34' has a diameter of about 0.031 inch, and the length of such exit opening is about 0.010 inch. The thickness of the orifice plate is about 0.063 inch. The purpose of the orifice plate is thought to be to eliminate swirling effects and other nonuniformities in the plenum chamber. Thus, the gaseous fluid presented to the venturi tends to be more uniform in flow than for annular flow, the latter occurring in the absence of such orifice plate.

The constant diametered throat 22' of the venturi 16' extends inwardly from the central entry opening 18' by a distance of about 0.094 inch; the throat has a length of about 0.031 inch and a diameter of about 0.033 inch. The Dyer patent discusses the significance of having a throat having some length to it. The converging wall portion 20' of the venturi has an angle of about 17.5° relative to the axis of the central entry opening of the venturi and the venturi central entry opening has a diameter of about 0.062 inch. The diverging wall portion of the venturi exit opening is about 5° or has a half angle of about 2.5° relative to the axis of the exit opening.

The angles and dimensions described above are thought to be critical in the effective operation of my invention, as previously mentioned.

A holder 52 aids in holding the venturi in position in addition to the corresponding use of the threaded plug 50', while an O-ring 54 provides a gas tight seal in known manner with the holder to prevent gas from escaping from the plenum chamber.

The yarn guiding needle 36' is adjustably spaced within the central bore 14' from the orifice plate 28' by means of the threaded member 56. The needle is secured to the threaded member by means of cooperating grooves and retaining rings 58. O-ring 60 serves as a gas seal in known manner. Rotation of the threaded member 56 serves to adjust the spacing of the needle relative to the orifice plate 28'.

In order to make the jet operate for fracturing and entangling yarn, the jet is adjusted to give a blow back of 2 psig. as determined by the following procedure. A constant 20 psig. air source is attached to the air inlet of the jet by a rubber hose. The yarn inlet of the jet is pressed and sealed against a pressure gauge. The threaded member 56 is adjusted until 2 psig. is obtained on the pressure gauge. This jet is said to be adjusted, then, to a blow back of 2 psig.

The invention has been described in detail with particular reference to certain preferred embodiments thereof, but it will be understood that variations and modifications can be effected within the spirit and scope of the invention.

I claim:

1. In a gaseous fluid jet for fracturing yarn, the jet including an elongated housing having a central bore therethrough defining a plenum chamber;

a venturi supported in the central bore and in the exit end of the housing, the venturi defining a passageway therethrough and the inner end of the venturi defining a central entry opening followed by a converging wall portion terminating in a constant diametered throat having a length approximately that of its diameter, the throat in turn being followed by a diverging wall portion leading to a central exit opening extending through the exit end of the venturi;

an orifice plate supported in the central bore of the housing and abutting against the inner end of the venturi, the orifice plate defining a central entry opening therethrough concentric with the central opening of the venturi, the wall of the entry opening having an inwardly tapering bevel terminating in an exit opening of constant diameter;

a yarn guiding needle positioned in the central bore of the housing and having an inner end portion adjustably spaced closely adjacent the entry opening of the orifice plate, the needle defining an axial yarn guiding passageway extending therethrough and terminating in an exit opening for directing yarn through the needle and toward the entry opening of the orifice plate, the outer wall of the inner end portion of the needle adjacent its exit opening being inwardly tapered toward the orifice plate entry opening; and means for directing a flow of pressurized gaseous fluid into the central bore of the housing and the plenum chamber and along the inner end portion of the needle whereby the gaseous fluid passes through the entry opening of the orifice plate and the entry opening of the venturi and outwardly through the exit opening of the venturi to partially fracture the yarn and entangle the filaments of the yarn as the yarn passes through the venturi from the axial yarn guiding passageway of the needle and the openings of the orifice plate; the improvement comprising:

providing the inward taper of the outer wall of the inner end portion of the needle with a half angle relative to the axis of the yarn guiding passageway of about 15°;

providing the wall of the orifice plate entry opening with an inwardly tapering bevel of about 30° relative to the axis of the central entry opening; and providing the diverging wall portion of the exit opening of the venturi with an angle of about 2.5° relative to the axis of the exit opening whereby the gaseous fluid jet is capable of using pressures of about 500 p.s.i.g. of gaseous fluid at a rate of about 6.5 SCFM to treat yarn.

2. The gaseous fluid fracturing jet as defined in claim 1, wherein the throat of the venturi extends inwardly from the central entry opening of the venturi by a distance of about 0.094 inch, the throat has a length of about 0.031 inch and a diameter of about 0.033 inch, the converging wall portion of the venturi has a half angle of about 17.5° relative to the axis of the central entry opening of the venturi and the venturi central entry opening has a diameter of about 0.062 inch.

3. The gaseous fluid fracturing jet as defined in claim 2, wherein the exit opening of the orifice plate has a diameter of about 0.031 inch, the length of the exit opening is about 0.010 inch, and the thickness of the orifice plate is about 0.063 inch.

4. The gaseous fluid fracturing jet as defined in claim 3, wherein the exit opening of the needle has a diameter no more than the diameter of the throat of the venturi.

* * * * *